US009269558B2

(12) United States Patent
Shiohama

(10) Patent No.: US 9,269,558 B2
(45) Date of Patent: Feb. 23, 2016

(54) MS/MS TYPE MASS SPECTROMETER AND PROGRAM THEREFOR

(75) Inventor: Tohru Shiohama, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 13/882,993

(22) PCT Filed: Sep. 30, 2011

(86) PCT No.: PCT/JP2011/072505

§ 371 (c)(1),
(2), (4) Date: May 2, 2013

(87) PCT Pub. No.: WO2012/063571

PCT Pub. Date: May 18, 2012

(65) Prior Publication Data

US 2013/0221214 A1 Aug. 29, 2013

(30) Foreign Application Priority Data

Nov. 10, 2010 (JP) ..... 2010-252271

(51) Int. Cl.
*H01J 49/26* (2006.01)
*H01J 49/00* (2006.01)

(52) U.S. Cl.
CPC ..... *H01J 49/26* (2013.01); *H01J 49/005* (2013.01); *H01J 49/0031* (2013.01)

(58) Field of Classification Search
CPC . H01J 49/0031; H01J 49/005; H01J 49/0036; G01N 30/8631
USPC ..... 250/281, 282
See application file for complete search history.

(56) References Cited

U.S. PATENT DOCUMENTS

| | | | | |
|---|---|---|---|---|
| 8,426,808 | B2 * | 4/2013 | Claude et al. | 250/282 |
| 2002/0019023 | A1 * | 2/2002 | Dasseux et al. | 435/40 |
| 2002/0095013 | A1 * | 7/2002 | Kathirgamanathan et al. | 525/540 |
| 2003/0027231 | A1 * | 2/2003 | Bryden et al. | 435/7.31 |
| 2003/0078739 | A1 * | 4/2003 | Norton et al. | 702/22 |

(Continued)

FOREIGN PATENT DOCUMENTS

JP 07-201304 8/1995

OTHER PUBLICATIONS

"International Search Report (Form PCT/ISA/210)", published on Nov. 1, 2011, with English translation thereof, p. 1-p. 2.

*Primary Examiner* — Wyatt Stoffa
(74) *Attorney, Agent, or Firm* — Jianq Chyun IP Office

(57) ABSTRACT

A method for selecting product ions at the time of performing multiple reaction monitoring (MRM) using an MS/MS type mass spectrometer is provided. Plurality of product ion scan events is prepared for certain precursor ions. In the product ion scan events, parameters for determining the cleavage conditions of the precursor ions are changed. Next, the precursor ions are introduced into a collision cell and the plurality of product ion scan events is executed, thereby obtaining a plurality of mass spectra corresponding to the respective product ion scan events. Then, the plurality of mass spectra is compared with one another, and ions corresponding to the mass peak with the highest appearance frequency are selected as product ions. Alternatively, ions having the highest cumulative signal intensity obtained by integrating the plurality of mass spectra are selected as product ions. Accordingly, optimum product ions for certain precursor ions are selected.

2 Claims, 5 Drawing Sheets

(56) References Cited

U.S. PATENT DOCUMENTS

| | | | | |
|---|---|---|---|---|
| 2004/0041090 | A1* | 3/2004 | Bloomfield et al. | 250/282 |
| 2005/0118650 | A1* | 6/2005 | Dasseux et al. | 435/7.2 |
| 2005/0139761 | A1* | 6/2005 | Yoshinari et al. | 250/282 |
| 2006/0020393 | A1* | 1/2006 | Goodlett et al. | 702/19 |
| 2006/0284067 | A1* | 12/2006 | Senko et al. | 250/282 |
| 2007/0069122 | A1* | 3/2007 | Augustin et al. | 250/288 |
| 2007/0085000 | A1* | 4/2007 | Furuhashi et al. | 250/288 |
| 2007/0117164 | A1* | 5/2007 | Raskov et al. | 435/7.23 |
| 2007/0158546 | A1* | 7/2007 | Lock et al. | 250/282 |
| 2009/0230298 | A1* | 9/2009 | Yamaguchi | 250/281 |
| 2009/0250605 | A1* | 10/2009 | Scigocki | 250/282 |
| 2009/0254285 | A1* | 10/2009 | Sadygov et al. | 702/22 |
| 2010/0102217 | A1* | 4/2010 | Okumura et al. | 250/281 |
| 2010/0305868 | A1* | 12/2010 | Roder et al. | 702/19 |
| 2011/0202282 | A1* | 8/2011 | Kostrzewa | 702/19 |
| 2011/0204218 | A1* | 8/2011 | Hager et al. | 250/282 |
| 2012/0326019 | A1* | 12/2012 | Claude et al. | 250/282 |

* cited by examiner

MS/MS TYPE MASS SPECTROMETER AND PROGRAM THEREFOR

CROSS-REFERENCE TO RELATED APPLICATION

This application is a 371 application of an international PCT application serial no. PCT/JP2011/072505, filed on Sep. 30, 2011, which claims the priority benefit of Japan application no. 2010-252271, filed on Nov. 10, 2010. The entirety of each of the above-mentioned patent applications is hereby incorporated by reference herein and made a part of this specification.

TECHNICAL FIELD

The present invention relates to an MS/MS type mass spectrometer subjecting an ion having a specific mass-to-charge ratio (m/z) to fragmentation by Collision-Induced Dissociation (CID) and conducting a mass analysis of product ions (fragment ions) generated by the fragmentation, and to a program used for the MS/MS type mass spectrometer.

BACKGROUND ART

As one of the mass spectrometric methods, a method called MS/MS analysis (also referred to as tandem analysis) has been known for conducting identification of a substance with a large molecular weight and analysis of its structure. A triple quadrupole (TQ) mass spectrometer is a typical MS/MS type mass spectrometer. FIG. 2 is a schematic configuration diagram of a generic triple quadrupole mass spectrometer disclosed in Patent Document 1 and so on.

Inside an analysis chamber 1 evacuated by an unillustrated vacuum pump, the mass spectrometer comprises an ion source 2 ionizing a sample to be analyzed, three quadrupoles 3, 5 and 6 with each composed of four rod electrodes, and a detector 7 detecting ions and outputting detection signals corresponding to the amount of the ions. A voltage composed of a DC voltage and a high frequency voltage is applied to the first-stage quadrupole 3, and due to an effect of an electric field resulting therefrom, from various kinds of ions generated by the ion source 2 only a target ion having a specific mass-to-charge ratio is selected as a precursor ion.

The second-stage quadrupole 5 is stored in a highly airtight collision cell 4. A CID gas, such as argon (Ar) gas, is introduced into this collision cell 4. After being sent from the first-stage quadrupole 3 to the second-stage quadrupole 5, the precursor ion collides with the CID gas in the collision cell 4, giving rise to fragmentation by CID to generate product ions. Since there are various modes of such fragmentation, normally, one kind of precursor ion generates plural kinds of product ions having different mass-to-charge ratios. These various kinds of product ions exit from the collision cell 4 and are introduced into the third-stage quadrupole 6. Normally, only a high frequency voltage is applied to, or a voltage formed by adding a DC bias voltage to a high frequency voltage is applied to the second-stage quadrupole 5, so that this second-stage quadrupole 5 functions as an ion guide for transporting ions to a subsequent stage while converging the ions.

Similar to the first-stage quadrupole 3, a voltage composed of a DC voltage and a high frequency voltage is applied to the third-stage quadrupole 6, and due to an effect of an electric field resulting therefrom, only product ions having a specific mass-to-charge ratio is selected in the third-stage quadrupole 6 and reaches the detector 7. By appropriately changing the DC voltage and the high frequency voltage applied to the third-stage quadrupole 6, the mass-to-charge ratio of the ions which are allowed to pass through the third-stage quadrupole 6 may be scanned (product ion scan). In this case, based on the detection signals obtained from the detector 7, an unillustrated data processing unit may create a mass spectrum (MS/MS spectrum) of the product ions generated by the fragmentation of the target ion. In addition, a precursor ion scan which scans all the precursor ions generating specific product ions, and a neutral loss scan which searches for all the precursor ions with a specific part of structure detached or the like are executable.

In addition, in devices where the aforementioned MS/MS type mass spectrometer is used as a detector of a liquid chromatograph (LC) and a gas chromatograph (GC), such as in LC/MS/MS and GC/MS/MS, a method called MRM (Multiple Reaction Monitoring) is often used for conducting a simultaneous analysis (identification and quantification) of multiple components contained in a sample. In an MRM measurement, with respect to each component, the mass-to-charge ratio of one kind or plural kinds of precursor ions selected in the first-stage quadrupole 3, and with respect to each precursor ion, the mass-to-charge ratio of one kind or plural kinds of product ions selected and measured in the third-stage quadrupole 6 are predetermined. Since the multiple components contained in the sample are temporally separated in the LC and GC in a previous stage, the aforementioned predetermined set of mass-to-charge ratios of the precursor ion and product ion may be respectively switched according to dissolution times (retention times) of each component. Thus, signal intensity of ions derived from each component may be sought with high precision and high sensitivity, and a quantitative measurement of the sample may be performed with high precision and high sensitivity.

To conduct a highly precise and highly sensitive analysis in an MRM measurement, it is important to correctly select the precursor ion and product ion with respect to each component. Here, for the precursor ion, it is fine to simply select a fixed one with respect to each component. However, since the product ion varies depending on the modes in which it is generated (fragmented) from the precursor ion, it is necessary to predetermine optimum values of various parameters (e.g. DC and AC voltages, etc. applied to each quadrupole) which influence the foregoing.

Conventionally, a selection of this optimum value is automatically preformed in the following method.

1) A setting for conducting a product ion scan analysis (hereafter referred to as "product ion scan event") is converted into various parameters and is prepared in plurality.

2) All the product ion scan events are executed in sequence.

3) From mass spectra of results of executing all the product ion scan events, one to a plurality of m/z is selected in order of increasing intensity. On that occasion, m/z within a tolerance range (e.g. ±0.5 m/z, etc.) is treated as one m/z.

4) The parameter of the product ion scan event generating the selected m/z is made the optimum value.

PRIOR-ART DOCUMENTS

Patent Documents

Patent Document 1: Japanese Patent Publication No. 07-201304

SUMMARY OF THE INVENTION

In the aforementioned conventional method, since the selection is made only in terms of maximum intensity, there is a possibility that a peak is selected from the mass spectra generated only under biased conditions. Accordingly, regarding the reproducibility of the analytical data and so on, inappropriate product ions may be selected, thus creating a need for a user to perform an operation of reviewing the data obtained by the automatic selection process and of again selecting the product ion from a plurality of candidates.

The present invention has been developed to solve the aforementioned problem, and an objective thereof is to provide an MS/MS type mass spectrometer capable of selecting optimum product ions with a higher probability.

Means for Solving the Problems

The present invention developed to solve the aforementioned problem is an MS/MS type mass spectrometer having a first mass separator selecting, from various kinds of ions, a product ion having a specific mass-to-charge ratio as a precursor ion; an ion fragmentation unit subjecting the precursor ion to fragmentation; a second mass separator selecting a product ion having a specific mass-to-charge ratio from various kinds of product ions generated by the fragmentation; a detector detecting the product ions selected by the second mass separator; and a control unit controlling the first mass separator, the ion fragmentation unit, the second mass separator and the detector to execute an analysis, and analyzing data resulting from the executed analysis. The control unit is characterized by having:

an event preparation unit, preparing, with respect to a precursor ion of a certain component, a plurality of product ion scan events among product ion scan events with conditions of at least one of the ion fragmentation unit and the second mass separator being changed as well as product ion scan events without any condition being changed;

an event execution unit, executing the prepared plurality of product ion scan events; and a detecting unit, detecting a mass peak with the highest appearance frequency from all mass spectra generated by all the executed product ion scan events.

In the MS/MS type mass spectrometer related to the present invention, the event preparation unit of the control unit prepares and selects product ion scan events among a plurality of the product ion scan events such as the following:

1) the product ion scan events with the conditions of at least one of the ion fragmentation unit and the second mass separator being changed;

2) the product ion scan events without any condition being changed.

For the precursor ion, the event execution unit subsequently executes the plurality of product ion scan events prepared in above way. A mass spectrum is obtained from each of the executed product ion scan events, and from a plurality of mass spectra obtained in this way, the detector detects the mass peak with the highest appearance frequency. The product ion corresponding to this mass peak is made as a product ion to select with respect to the precursor ion, conditions of the product ion scan event corresponding to the mass spectrum where the mass peak appears are made analytical conditions, and an analysis of components thereof is conducted.

Furthermore, in addition to the mass peak with the highest appearance frequency, the mass peaks with the second highest and third highest appearance frequency and so on may also be selected.

Whereas conventionally, it was not possible to select appropriate product ions, but instead to select the mass peak appearing only under certain special conditions since the mass peak having the maximum intensity had been detected. The method related to the present invention is capable of selecting appropriate product ions by selecting the mass peak with the highest appearance frequency.

Furthermore, in the MS/MS type mass spectrometer related to the present invention, the detector of the control unit may also, instead of detecting the mass peak with the highest appearance frequency from all the mass spectra, calculate an added value or average value of all the mass spectra to detect the most intensive mass peak among those.

In addition, the most intensive mass peak may be detected among the added value/average value not obtained by simple addition/simple averaging but taking account of weighting of each mass spectrum (i.e. weighted added value/weighted average value).

In any case, it is possible to select more appropriate product ions compared to obtaining the mass peak with the maximum intensity from all the mass spectra as conventionally.

The aforementioned event preparation unit may automatically set, or allow a user to input, conditions of each product ion scan event.

In addition, a program used for an MS/MS type mass spectrometer related to the present invention is a program for an MS/MS type mass spectrometer, wherein the MS/MS type mass spectrometer has a first mass separator, selecting, a product ion, from various kinds of ions, having a specific mass-to-charge ratio as a precursor ion; an ion fragmentation unit, subjecting the precursor ion to fragmentation; a second mass separator, selecting a product ion having a specific mass-to-charge ratio from various kinds of product ions generated by the fragmentation; a detector, detecting the product ions selected by the second mass separator; and a control unit, controlling the first mass separator, the ion fragmentation unit, the second mass separator and the detector in executing an analysis, and analyzing data resulting from the executed analysis. The program is characterized by having:

an event preparation unit preparing product ion scan events among a plurality of product ion scan events with the conditions of at least one of the ion fragmentation unit and the second mass separator being changed as well as product ion scan events without any condition being changed;

an event execution unit executing the prepared plurality of product ion scan events; and a detecting unit, detecting a mass peak with the highest appearance frequency from all mass spectra generated by all the executed product ion scan events.

Also, with respect to this program, it is possible to be imparted with various functions such as the above (selection of the second and later mass peak, selection according to an added value/average value and weighted added value/weighted average value, automatically set/user defined conditions, etc.)

According to the MS/MS type mass spectrometer related to the first invention, with respect to each precursor ion, since optimum product ions may be selected with a higher probability, an analysis of each component of the sample may be conducted with higher precision and higher sensitivity.

DESCRIPTION OF EMBODIMENTS

Figure 1:
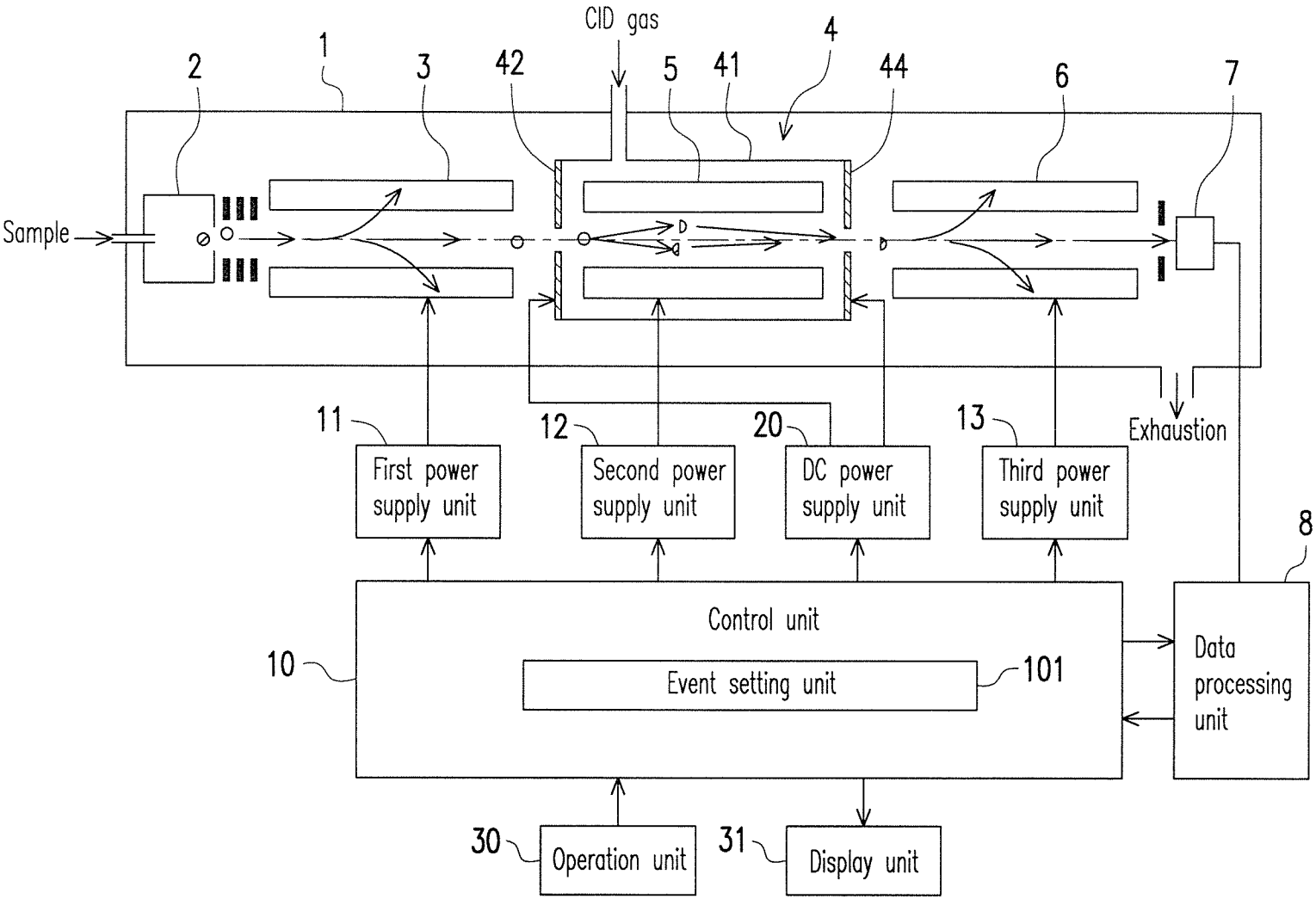
FIG. 1 is an overall configuration diagram of an MS/MS type mass spectrometer according to an embodiment of the present invention.
Figure 2:
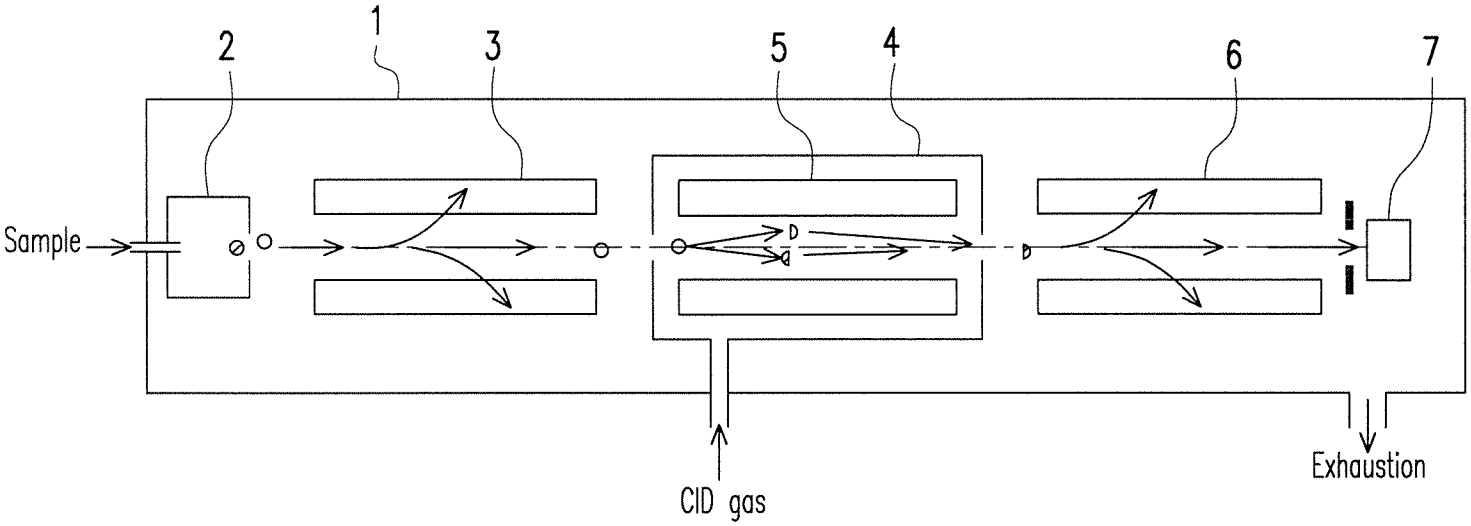
FIG. 2 is an overall configuration diagram of a generic MS/MS type mass spectrometer.
Figure 3:
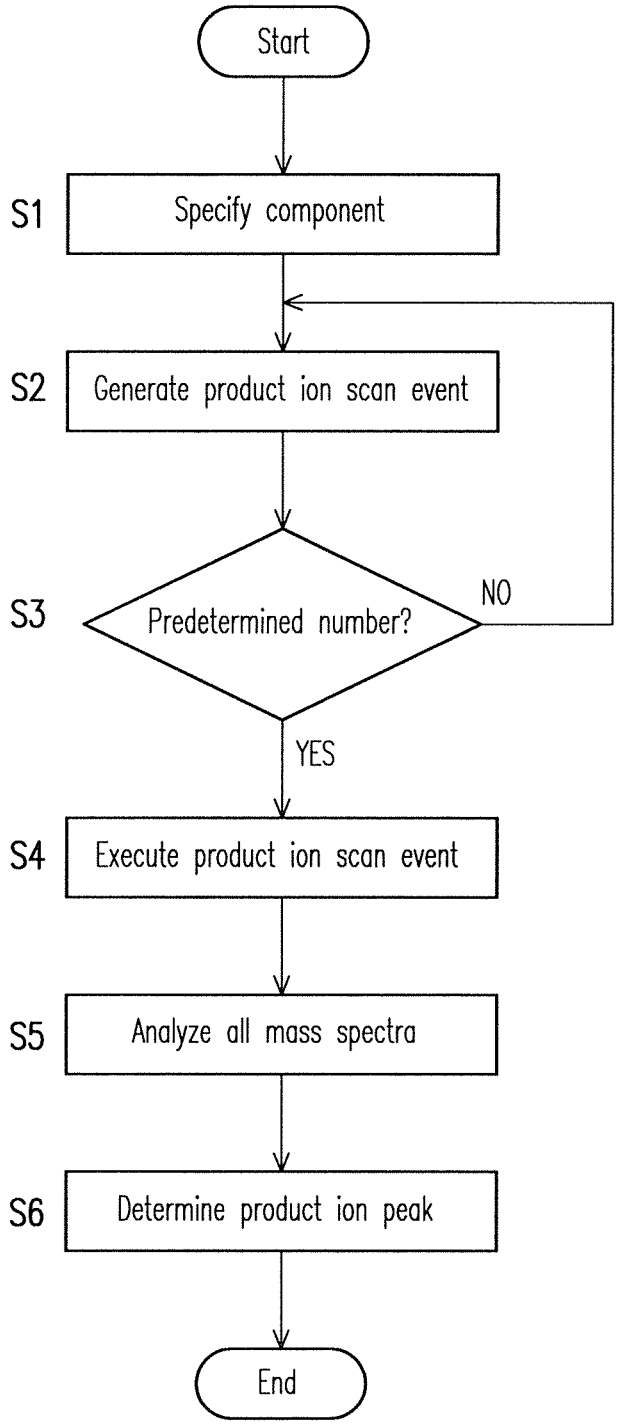
FIG. 3 is a flowchart of a process pre-performed by the control unit in the MS/MS type mass spectrometer in the embodiments to determine the set of mass-to-charge ratio of the precursor ion and product ion.

In the following, an embodiment of the MS/MS type mass spectrometer related to the present invention is explained with reference to the accompanying drawings. FIG. 1 is an overall configuration diagram of the MS/MS type mass spectrometer of the present embodiment. Furthermore, the same elements in the conventional configuration (FIG. 2), which have already been explained, are assigned with the same reference numerals, and descriptions thereof are omitted.

In the MS/MS type mass spectrometer of the present embodiment, a collision cell 4 is disposed between the first-stage quadrupole 3 and the third-stage quadrupole 6 to subject a precursor ion to fragmentation to generate various product ions, and inside the collision cell 4 the second-stage quadrupole 5 having no mass separation function is arranged. The first-stage quadrupole 3 and the third-stage quadrupole 6 are quadrupole mass filters, while the second-stage quadrupole 5 is simply a quadrupole (or multipole) ion guide.

In the collision cell 4, the second-stage quadrupole 5 is disposed in a cylindrical body 41 formed by insulating members, an entrance-side lens electrode 42 is disposed on an ion incidence side end face of the cylindrical body 41, and an exit-side lens electrode 44 is disposed on an ion exit side end face of the cylindrical body 41.

A voltage composed of a DC voltage and a high frequency voltage, or a voltage formed by further adding a predetermined DC bias voltage to the foregoing is applied from a first power supply unit 11 to the first-stage quadrupole 3. A high frequency voltage only, or a voltage formed by adding a predetermined DC bias voltage to the high frequency voltage is applied from a second power supply unit 12 to the second-stage quadrupole 5. A voltage composed of a DC voltage and a high frequency voltage, or a voltage formed by further adding a predetermined DC bias voltage to the foregoing is applied from a third power supply unit 13 to the third-stage quadrupole 6. The first to the third power supply units 11, 12 and 13 are operated under the control of a control unit 10 composed of computers. Predetermined voltages are applied from a DC power supply unit 20 to the entrance-side lens electrode 42 and the exit-side lens electrode 44 of the collision cell 4, respectively.

In the event that the MRM measurement is performed by the MS/MS type mass spectrometer of the present embodiment, operations of the control unit 10 are as follows. Here, it is assumed that the LC or GC is connected to a previous stage of the mass spectrometer, a sample containing components temporally separated in the LC and GC is introduced with the progress of time, and the components in this sample are detected in sequence according to an MRM method. In the MRM measurement, a mass-to-charge ratio A of the precursor ion selected by the first-stage quadrupole 3 and a mass-to-charge ratio a (a<A) of the product ion selected by the third-stage quadrupole 6 are fixed, and different A and a are set in each component of an object for measurement. Consequently, switching of mass-to-charge ratio of the precursor ion in the first-stage quadrupole 3 and switching of mass-to-charge ratio of the product ion in the third-stage quadrupole 6 are performed. Sets of mass-to-charge ratios of the precursor ion and product ion must be set in advance, in corresponding to the retention time, as one of analytical conditions by an analyst by means of an operation unit 30. The process pre-performed to determine these sets of mass-to-charge ratios of the precursor ion and product ion is explained below.

First, the user inputs components intended for analysis by means of the operation unit 30 (step S1). Here, in addition to manually inputting names of the components, a method of selecting from those displayed on a screen of a display unit 31 is also prepared. For a component input in this way, the control unit 10 determines the precursor ion by referring to a pre-prepared database. Once the precursor ion is determined, voltage conditions and so on of the first-stage quadrupole 3 for selecting the mass-to-charge ratio of the precursor ion are automatically determined.

Next, the control unit 10 generates only a predetermined number of (plural) product ion scan events which set the voltage conditions of the collision cell 4 for subjecting the precursor ion to fragmentation and to the product ion scan conditions, such as scan conditions of the third-stage quadrupole 6 for scanning the product ion (steps S2~S3). The product ion scan event may be automatically generated according to a predetermined algorithm for each kind of precursor ion, or, a part of or all of the user's parameter input values may be utilized. In addition, all the conditions may include the same plurality of product ion scan events because there is a possibility that influences on the results due to sudden noises and so on are different by varying an execution time thereof.

After the predetermined number of product ion scan events is generated, the control unit 10 executes those product ion scan events in sequence (step S4). That is, according to the conditions set by each product ion scan event, the first power supply unit 11, the second power supply unit 12, the DC power supply unit 20, and the third power supply unit 13 are controlled to select the predetermined precursor ions, and the predetermined precursor ions are fragmented and detected by the detector 7, so that the mass spectra of each product ion scan event are obtained.

After executing all the product ion scan events, the control unit analyzes all the mass spectra obtained by those executions (step S5), and determines the peak of optimum product ions with respect to the present precursor ion. Methods of determining the optimum product ion peak here will be explained in detail later. In this way, after the set of mass-to-charge ratios of the precursor ion and product ion is determined, an analysis of the sample is conducted. On that occasion, with respect to each component, the set of mass-to-charge ratios of the precursor ion and product ion determined as above (i.e. product ion scan conditions) is used.

The methods of determining the peak of optimum product ions from all the mass spectra obtained from all the product ion scan events is described herein. One of the methods is a method of making the peak occurred at the highest frequency among all the mass spectra the optimum product ion peak. Furthermore, on this occasion, m/z within a predetermined tolerance range (e.g. ±0.5 m/z, etc.) is to be treated as one m/z. Conventionally, it was possible that the peak was selected from the mass spectra generated only under some kind of biased conditions. Since such a peak is almost never occurred at the high frequency, that kind of false selection of peak is prevented.

Figure 4:
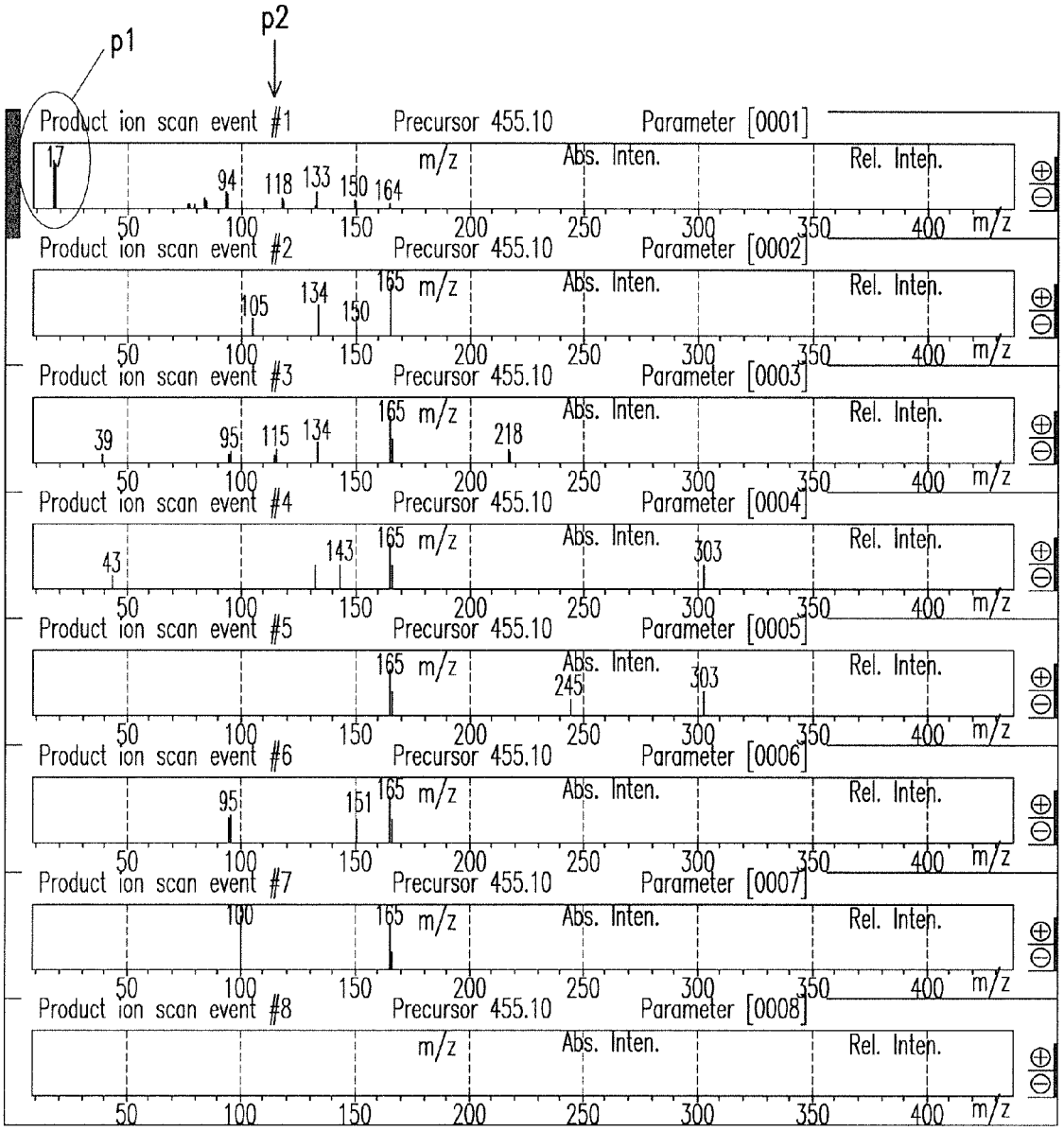
FIG. 4 is a combined diagram of mass spectra for illustrating one of the methods of determining optimum product ions.

An example of selecting the optimum product ion peak in such way is explained with reference to FIG. 4. FIG. 4 shows that with respect to the precursor ion with Da (dalton) =455.10, eight product ion scan events are generated with conditions different from one another (parameters [0001]~[0008]), and the mass spectra obtained from execution of those product ion scan events are displayed lengthwise on the display unit 31. In this example, a peak p1 with m/z=17 appears specifically only in the initial product ion scan event ("product ion scan event #1"), while the peak does not appear in the other product ion scan events. Furthermore, since this peak is the highest among all the spectra, in conventional methods, the peak was selected as the product ion of the precursor ion, and its condition (parameter [0001]) had just been selected as an analytical condition for components thereof. However, as the aforementioned method is used in the mass spectrometer related to the present invention, the peak (m/z=165) appearing in the six mass spectra of product ion scan events #2~#7 is selected. Since such selected peak may be said that the product ion is generated most stably, it can be said that this is the product ion most suitable to select for analysis of its components.

In addition, as another method of determining the peak of optimum product ions from all the mass spectra obtained from all the product ion scan events, there is a method where the intensity of each m/z with respect to all the mass spectra is added up and the peak with the maximum intensity is made the optimum product ion peak. Also, in this way, wrongly selecting the peak that appears only under some kind of biased conditions is prevented.

Figure 5:
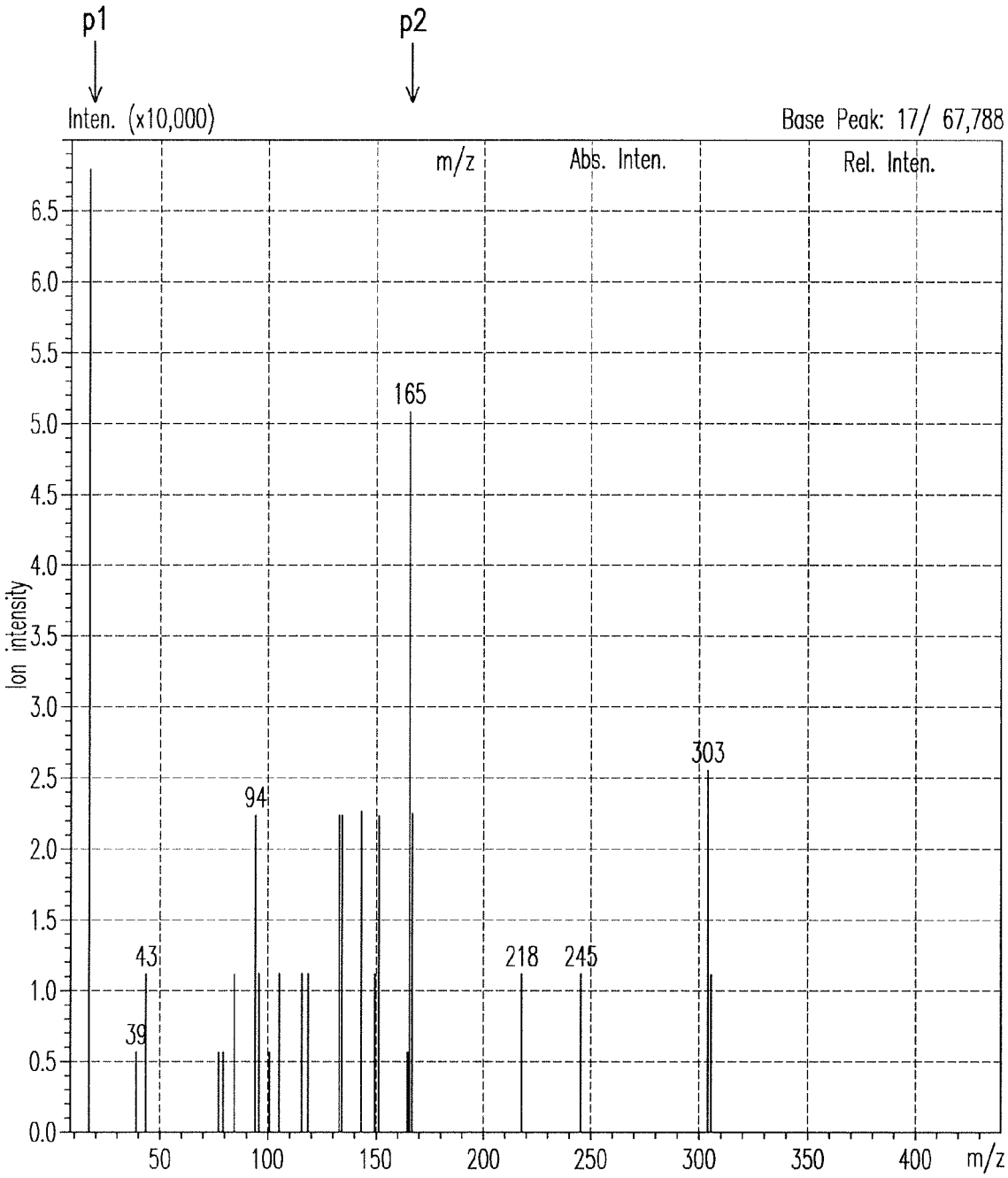
FIG. 5 is an overlay diagram of mass spectra for illustrating another method of determining optimum product ions.

An example of this case is explained with reference to FIG. 5. FIG. 5 shows that the mass spectra generated by the eight product ion scan events in the aforementioned example are overlay-displayed on the screen of the display unit 31. As described above, though the large peak p1 appears at m/z=17, the peak of m/z=165 appears in the seven spectra, and a total by adding up peak strengths in all mass spectra is far higher than the peak of m/z=17. Accordingly, in this case, same as the above, the peak of m/z=165 is selected.

Furthermore, since a selection of the maximum value of the summed value of m/z intensities of all the mass spectra is equivalent to a selection of the maximum value of an average value of m/z intensities of all the mass spectra, the maximum value of an average value may also be selected.

In addition, the most intensive peak may be detected among the added value/average values not obtained by simple addition/simple averaging but taking account of weighting of each mass spectrum (i.e. weighted added value/weighted average value).

Any of the aforementioned embodiments is one example of the present invention, and any change, addition or modification appropriately made within the spirit of the present invention will be obviously included in the scope of claims of the present patent application.

What is claimed is:

1. An MS/MS type mass spectrometer, comprising:

a first mass separator, selecting, from various kinds of ions, a product ion having a specific mass-to-charge ratio as a precursor ion;

an ion fragmentation unit, subjecting the precursor ion to fragmentation;

a second mass separator, selecting a product ion having a specific mass-to-charge ratio from various kinds of product ions generated by the fragmentation;

a detector, detecting the product ion selected by the second mass separator; and a control unit, controlling the first mass separator, the ion fragmentation unit, the second mass separator and the detector to execute an analysis, and analyzing data resulting from the executed analysis, wherein the control unit further comprises:

an event preparation unit, preparing, with respect to the precursor ion of a certain component, a plurality of product ion scan events among product ion scan events with conditions of at least one of the ion fragmentation unit and the second mass separator being changed as well as product ion scan events without the conditions being changed;

an event execution unit, executing the prepared plurality of product ion scan events; and a detecting unit, detecting a mass peak with the highest appearance frequency from all mass spectra generated by all the executed product ion scan events, wherein the mass peak with the highest appearance frequency is selected determined to be an optimum product ion peak of the precursor ion by the control unit.

2. A method for operating an MS/MS type mass spectrometer, comprising:

selecting, from various kinds of ions, a product ion having a specific mass-to-charge ratio as a precursor ion by a first mass separator;

subjecting the precursor ion to fragmentation by an ion fragmentation unit;

selecting a product ion having a specific mass-to-charge ratio from various kinds of product ions generated by the fragmentation by a second mass separator;

detecting the product ion selected by the second mass separator by a detector; and providing a control unit, having a computer which controls the first mass separator, the ion fragmentation unit, the second mass separator and the detector to execute an analysis, and which analyzes data resulting from the executed analysis, wherein the computer performs following operations:

preparing a plurality of product ion scan events among product ion scan events with conditions of at least one of the ion fragmentation unit and the second mass separator being changed as well as product ion scan events without any condition being changed;

executing the prepared plurality of product ion scan events;

detecting a mass peak with the highest appearance frequency from all mass spectra generated by all the executed product ion scan events; and determining the mass peak with the highest appearance frequency to be an optimum product ion peak of the precursor ion.

* * * * *